United States Patent [19]

Fatool

[11] Patent Number: 5,023,128

[45] Date of Patent: Jun. 11, 1991

[54] IMPACT-ABSORBING PAD

[75] Inventor: Wade T. Fatool, Sunbury, Pa.

[73] Assignee: Competitive Athletics Technology, Inc., Winfield, Pa.

[21] Appl. No.: 305,742

[22] Filed: Feb. 3, 1989

Related U.S. Application Data

[63] Continuation-in-part of Ser. No. 212,871, Jun. 29, 1988, abandoned.

[51] Int. Cl.[5] ..... B32B 3/20; A47G 9/06

[52] U.S. Cl. ..... 428/172; 428/167; 428/178; 428/188; 428/304.4; 2/267; 5/417; 5/431; 5/442; 5/449; 267/142; 267/153

[58] Field of Search ..... 428/36, 72, 167, 166, 428/178, 188, 179, 304.4, 338, 35.6, 36.5, 36.8, 57, 58, 156, 167, 172, 192; 273/195 R; 404/35; 2/267, 339; 5/417, 420, 431, 442, 449, 455; 267/142, 69.11, 153, 292, 141, 145; 42/403

[56] References Cited

U.S. PATENT DOCUMENTS

| | | | |
|---|---|---|---|
| 2,657,385 | 11/1953 | Cushman et al. | 2/24 |
| 2,822,554 | 2/1958 | Wenzelberger | 5/337 |
| 4,118,019 | 10/1978 | Weir | 267/153 |
| 4,142,252 | 3/1979 | Storer | 2/24 |
| 4,172,749 | 10/1979 | Liggett | 156/244 |
| 4,408,365 | 10/1983 | Palmer | 15/112 |
| 4,513,048 | 4/1985 | Kaube et al. | 428/188 |
| 4,533,583 | 8/1985 | May | 428/69 |
| 4,671,028 | 6/1987 | Figone | 52/108 |

*Primary Examiner*—Patrick Ryan
*Assistant Examiner*—Donald J. Loney
*Attorney, Agent, or Firm*—Thomas Hooker

[57] ABSTRACT

Am impact-absorbing pad includes a plurality of parallel, elongated, individually sealed hollow pneumatic tubes with coextensive webbing. Each tube includes opposing lengthwise interior ridges. Upon compression of a tube, the trapped air is compressed and the ridges contact each other, resisting compression and pressing outwardly to spread the force of impact.

14 Claims, 1 Drawing Sheet

IMPACT-ABSORBING PAD

BACKGROUND OF THE INVENTION

This application is a continuation-in-part of my copending application Ser. No. 212,871, filed June 29, 1988, now abandoned.

1. Field of the Invention

This invention relates to impact-absorbing pads, and in particular to impact-absorbing padding which includes a plurality of elongated, hollow, air-filled, sealed tubes attached to each other by coextensive webbing and having opposed compressible ridges on facing inner walls.

2. Description of the Prior Art

There are many types of padding intended to absorb impact. These pads resiliently and dampingly resist compression. Some pads are merely shaped cushions made of substantially homogeneous material such as rubber, resilient cellular foam or the like, externally shaped as needed. Such a pad may also incorporate an air cavity. U.S. Pat. No. 2,822,554 to Wenzelberger discloses an inflatable, elongated cushion of sponge rubber. The Wenzelberger cushion has an elongated, air-filled central cavity with opposed inner corrugated walls. The walls are corrugated for better flexibility.

Many pads are designed to protect athletes and others from injury. For example Cushman, in U.S. Pat. No. 2,657,358, discloses a general purpose pneumatic pad characterized by a plurality of tubes separated by webbing. The overall pad is closed to confine air in the tubes and the individual tubes communicate with one another at their ends to provide a balancing effect whereby the pressure in all the tubes equalizes even where only one tube is compressed. U.S. Pat. No. 4,142,252 to Storer discloses an athletic protective pad which utilizes a plurality of pneumatic tubes also connected to the same closed air volume. A pad with a plurality of tubes connected by constricted passageways is also common to many air mattresses where the passageways pressure equalize the tubes during inflation and use. The pad of the present invention also has hollow tubes. However, the internal volumes of the tubes are not connected to one another for equalization of pressure. The tubes are joined together by impermeable webbing. Each tube has a separate closed chamber extending between closed tube ends. When the pad is loaded the tubes are made smaller and the air in the tubes is compressed to spread the load and cushion shock.

Opposed internal ridges or stops extend along the tops and bottoms of the tube chambers. When the pad is compressed the ridges in the chambers come into contact with each other, are themselves compressed and cooperate in resisting deformation of the pad. Individual tubes are joined to each other to resist compression. This tends to spread the load when less than all tubes are compressed, the load resulting in transverse force through the web to non-stressed tubes. Only the air pressure in the compressed tube is increased with loading. The pad is especially suited to certain impact resisting applications.

SUMMARY OF THE DISCLOSURE

The pad of the present invention is comprised of a plurality of elongated hollow pneumatic tubes, preferably foam rubber tubes, each defining a discrete elongated closed inner chamber. Each tube is generally rectangular in its outer cross section and is joined to an adjacent parallel tube along one or two of its exterior walls by a central web coextensive with the tube extending perpendicular to the exterior wall of the next tube. The web is solid and does not communicate the chambers. Each of the tubes is individually sealed at both ends, trapping air in the chamber independent of pressure variations in other tubes. The inner wall defining the chamber of each tube is provided with opposing ridges or stops running the length of the chamber, the ridges preferably being extending along the top and the bottom of the chambers and opposing each other such that when an individual tube is flattened by sufficient pressure on the pad, the ridges on the opposing surfaces meet and are themselves compressed. An oblique force may cause the ridges to slide over one another, providing additional frictional resistance to collapse. Air pressure in the chamber increases, due to the sealed ends, and also resists collapse of the tube. An high pressure may flatten the tubes. The tube-webbing arrangement in the pad, when compressed immediately causes localized compressive forces to be spread transversely out through the pad without collapsing or increasing pressure in adjoining tubes.

An object of this invention is to provide an impact-absorbing pad which includes a plurality of pneumatic, individually sealed flattenable tubes inter-connected by impermeable webbing.

Another object of this invention is to provide an impact-absorbing pad which resists compression and lateral distortion by spreading localized compressive forces along the pad.

It is a further object of this invention to provide an impact-absorbing pad which includes joined hollow closed tubes, each tube including opposing ridges running the length of each tube to mechanically resist complete collapse of the tubes.

These and other objects will be more readily ascertainable to one skilled in the art from the following disclosure, with the understanding that the disclosure is illustrative only and that changes may be made in the specific construction illustrated and described within the scope of the appended claims.

DETAILED DESCRIPTION OF THE PREFERRED EMBODIMENTS

Figure 1:
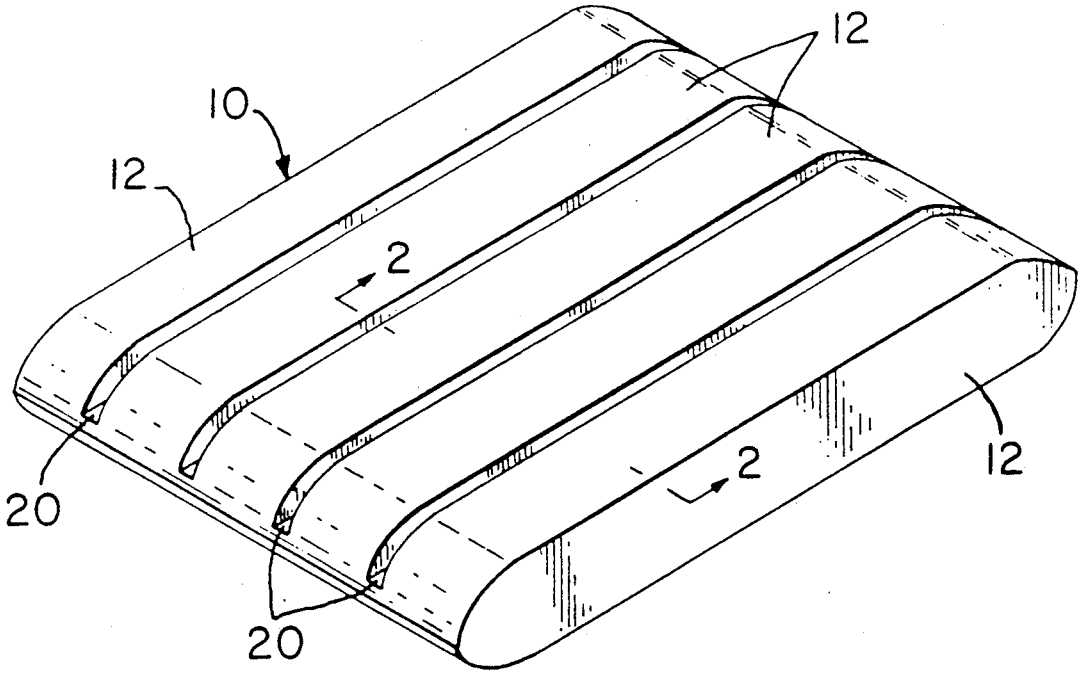
FIG. 1 is a perspective view of the impact-absorbing pad of this invention.

Referring now to the drawings, impact-absorbing pad 10 is shown having a plurality of pneumatic tubes 12 disposed generally parallel and joined along their lengths with coextensive webbing 20, defining a substantially flat pad. Each elongated tube 12 is generally rectangular in outer cross section and has a central chamber 14 with parallel opposed side walls 22 and top and bottom ridges or stops 16. The chambers are sealed off at tube ends 18 to define a closed volume in which air or other gas is trapped. The relative length and width of pad 10 (that is the length of the tubes 12 and the number of coextensive tubes 12 connected together) depend on user preference of a particular application. The pad 10 is preferably formed integrally of high density foam rubber. The density of the foam used can be varied, dependent upon the end use of the pad together with other variables such as the internal air pressure, the density of the connective webs and the like.

In the embodiment illustrated herein, the pad and the tubes are dimensioned for use as an athletic pad, such as a knee pad. Each tube 12 is approximately 7/16" high and ⅜" wide externally. Chamber 14 is about ¼" high and ⅛" wide with the ridges separated by about ⅛".

The webbing 20 joins the tubes midway between the top and bottom of the pad and is approximately ⅛" thick and 1/16" wide. The webbing 20 separates adjacent tubes 12 and defines the pair of slots between each adjacent tubes. The webbing is compressible so that when the pad is subject to loading the web may be collapsed to bring adjacent tubes into contact to convey lateral forces between tubes within the plane of the pad. It is preferred that the pad webbing and tubes be formed from integral extruded cellular foam stock.

Each tube 12 is individually sealed at least at its extreme ends 18, preferably with an adhesive or a resin that remains flexible when cured. By sealing ends 18, air is trapped in chamber 14 to aid in compression resistance. Alternatively, the tube ends may be sealed by resin plugs. Small chambers may be provided by pinching and welding the tube closed at several points along their lengths, thus increasing the air pressure inside each tube when loaded.

By utilizing a plurality of individually sealed tubes 12, joined yet spaced apart by webbing 20, pad 10 spreads compressive force outwardly from the point of compression at one tube or several adjacent tubes. Additionally, the trapped air in each tube 12 is pressurized with flattening of the tube and thereby aids in the impact resistance of the tube. Ridges 16 are deformed to resist loading and spread forces. These features are especially important when the pad is used to protect athletes because sudden impact to a portion of the pad (worn on a knee, for example) is absorbed by the pneumatic tubes and ridges and is spread out by the webbing reducing the force at the impact point.

Webs 20 separate each tube 12 from adjacent tubes 12 by a sufficient distance so that the entire pad 10 can be bent at any webbing row or succession of adjacent rows. This allows pad 12 to be used to protect a rounded surface, such as a user's knee. Similarly, the pad may be bent around a stationary object to prevent injury.

Figure 2:
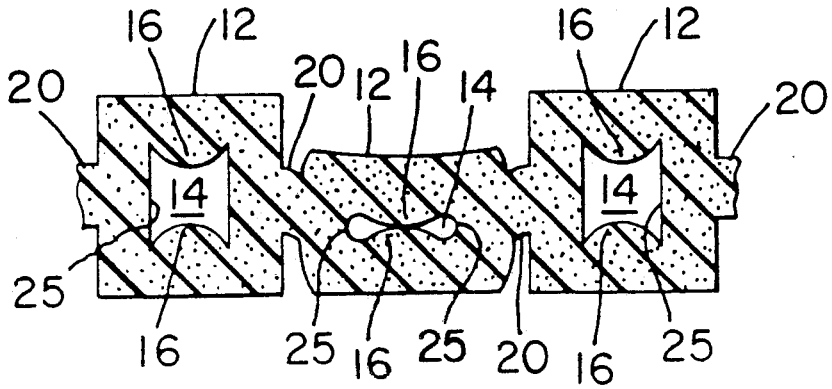
FIG. 2 is a cross section taken on line 2—2 of FIG. 1 illustrating the structure of the pad.

FIG. 2 shows uncompressed and compressed tubes 12. Each tube 12 has a chamber 14 including opposed lengthwise ridges 16 on the top and bottom of the chamber. Ridges 16 are preferably rounded humps, oppose each other and extend across the width of the chamber so that the chamber has an hourglass shaped cross section. When tube 12 is partially compressed in the direction of arrows 22 and 24, ridges 16 meet and with further compression the ridge flatten each other and retard collapse of the tube. The ridges can be deep, to meet initially at relatively little compression, or the ridges can be shallow such that only increasing air pressure resists compression until nearly full collapse.

Webs 20 press outwardly against the adjacent tubes 12, distributing the force of impact and/or pressure rather than concentrating it on one tube 12. The webs being solid and relatively non-compressible, forces carried by the webs are spread immediately rather then slowly as would occur, for example, if restricted flow air passages connected the tubes. Flattening of the tube ridges 16 urges webs 20 outwardly due to the increased width of the tube. These features cause the pad to respond well to sudden impact and dissipate forces as needed, for example, in athletic pads.

There are many advantages to the impact-absorbent pad of this invention. Chiefly, its sealed tubes with coextensive webs absorb and spread impact forces beyond the point of impact or compression, permitting the resilience, and dash-pot force damping effects of the whole pad to respond to impacts localized at one or several of the tubes.

Having now illustrated and described my invention, it is not intended that such description limit this invention, but rather that this invention be limited only by reasonable interpretation of the appended claims.

What is claimed is:

1. An impact-absorbing pad formed of an integral body of compressible resilient material comprising a plurality of elongated, parallel, hollow pneumatic tubes extending side-by-side across the pad and defining a plurality of elongate, parallel central chambers extending side-by-side across the pad, said tubes being generally rectangular in outer cross section with top and bottom surfaces and side surfaces, said top and bottom surfaces defining the top and bottom of the pad and said side surfaces facing each other and being spaced apart from each other by a short distance, each tube being joined to an adjacent tube along one of its lengthwise side surfaces by an elongate web coextensive with elongate said side surfaces, each said elongate tube being sealed at spaced locations in order to trap air inside said tubes to provide a pad which resists compression.

2. The impact absorbing pad according to claim 1, wherein each said tube includes an elongate ridge extending along the top or bottom wall of the chamber.

3. The impact absorbing pad according to claim 1 wherein said webs are located between the top and bottom surfaces of the pad and the each web and adjacent tubes define grooves separating the tubes.

4. The impact absorbing pad according to claim 1, wherein each said tube includes elongate ridges on the top and bottom walls of the chambers.

5. The impact absorbing pad according to claim 4 wherein said ridges are rounded and extend across the width of the chambers.

6. The impact absorbing pad according to claim 4 including a plurality of plugs, said plugs closing said chambers.

7. The impact absorbing pad according to claim 4 wherein each tube is sealed at predetermined intervals along its length.

8. The impact absorbing pad according to claim 4 wherein each tube is sealed by pinching said tube closed.

9. The impact absorbing pad according to claim 4 wherein each said tube is sealed closed by an adhesive.

10. The impact absorbing pad according to claim 4 wherein the chambers of said tubes are hourglass shaped in cross section.

11. Stock material for forming an impact-absorbing pad, said material including an integral extruded body of indefinite length formed from compressible resilient material, said body including a plurality of closely spaced elongated, parallel hollow open ended tubes, each tube being generally rectangular in cross section, and webs located between and joining each adjacent pair of tubes, the webs having a thickness less than the heighth of the tubes and the sides of the tubes are adjacent each other, said tubes being hollow and defining interior chambers extending along the length of the material, each chamber including an inwardly projecting ridge on the top or bottom wall thereof.

12. Stock material as in claim 11 including ridges on the top and bottom walls of each tube.

13. Stock material as in claim 12 wherein said chamber are hourglass shaped in cross section.

14. Stock material as in claim 11 wherein the webs are located midway between the top and bottom of the stock material.

* * * * *